US006462487B1

(12) United States Patent
Lefort et al.

(10) Patent No.: US 6,462,487 B1
(45) Date of Patent: Oct. 8, 2002

(54) METHOD OF OPERATING A CATHODE-RAY TUBE ELECTRON GUN

(75) Inventors: Michel Lefort, Varanges; Jean-Pierre Garnier, Couternon, both of (FR)

(73) Assignee: Thomson Tubes & Displays, S.A., Boulogne Cedax (FR)

( * ) Notice: Subject to any disclaimer, the term of this patent is extended or adjusted under 35 U.S.C. 154(b) by 0 days.

(21) Appl. No.: 09/581,266

(22) PCT Filed: Dec. 16, 1998

(86) PCT No.: PCT/EP98/08168

§ 371 (c)(1),
(2), (4) Date: Aug. 21, 2000

(87) PCT Pub. No.: WO99/35664

PCT Pub. Date: Jul. 15, 1999

(30) Foreign Application Priority Data

Dec. 31, 1997 (FR) ..... 97 16766

(51) Int. Cl.[7] ..... G09G 1/04

(52) U.S. Cl. ..... 315/382; 315/381; 315/379; 315/16

(58) Field of Search ..... 315/14, 16, 379, 315/381, 382, 382.1; 313/414, 449; 348/745, 806

(56) References Cited

U.S. PATENT DOCUMENTS

| | | | | |
|---|---|---|---|---|
| 4,315,152 A | * | 2/1982 | Smith | 250/396 ML |
| 4,319,163 A | | 3/1982 | Chen | 315/14 |
| 4,409,514 A | | 10/1983 | Shefer et al. | 313/449 |
| 4,884,874 A | * | 12/1989 | Buzak et al. | 349/31 |
| 4,990,832 A | | 2/1991 | Maninger et al. | 315/382 |
| 5,336,973 A | * | 8/1994 | Leroux et al. | 315/14 |
| 5,483,128 A | | 1/1996 | Chen | 315/382 |
| 5,532,547 A | | 7/1996 | Park et al. | 313/414 |
| 5,689,158 A | | 11/1997 | Chen | 315/382 |
| 5,872,432 A | * | 2/1999 | Beeteson | 315/382.1 |

* cited by examiner

*Primary Examiner*—Haissa Philogene
(74) *Attorney, Agent, or Firm*—Joseph S. Tripoli; Dennis H. Irlbeck; Carlos M. Herrera

(57) ABSTRACT

A method for operating a cathode-ray tube electron gun, suitable for multimode operation, for example, in order to display television images and multimedia images of the SVGA, XGA type, in which the zone for forming the electron beam generated by the cathode has at least two control electrodes. The two control electrodes are connected to voltage sources in such a way that the potential difference between the two control electrodes increases when the beam current decreases.

5 Claims, 4 Drawing Sheets

METHOD OF OPERATING A CATHODE-RAY TUBE ELECTRON GUN

The invention relates to a method for operating an electron gun within a cathode-ray tube, and more particularly, to a method for controlling the electrodes of an electron gun to allow optimized operation of the gun for several operating modes, for example, in television mode and in monitor mode, in order to display high-resolution images of the SVGA or XGA type.

BACKGROUND OF THE INVENTION

An electron gun generally consists of a zone called the beam-forming zone, forming a triode, comprising an emissive cathode, a first electrode G1, generally connected to a zero voltage, and a second control electrode G2, generally connected to a voltage of about a few hundred volts. In the case of a three-beam gun, for a trichrome tube, three emissive cathodes K are used to form three beams corresponding to the three primary colors to be generated on the screen, and the three beams pass through the grids G1 and G2, which are pierced, for example, with three holes arranged along the axes of said beams. Other electrode means, constituting a main lens, are arranged beyond the zone for forming the beam or beams, in order to focus the beams and/or to make the beams converge on the screen of the tube.

There is a rapidly growing tendency which requires the television tube, and the television set equipped with such a tube, to be able to display both television images and images arising from a multimedia application, in which the television set and its tube act as a microcomputer monitor.

However, although television images, for contrast and brightness reasons, are generated from high-current electron beams, high-resolution images for multimedia applications are, on the contrary, generated using low-current electron beams. This gives rise to a compromise problem in the design of the gun, since the known triode structure K, G1, G2 is suitable for one type of operation, but cannot be optimized for another, very different type of operation, for example, in a television mode or in a multimedia monitor mode.

The invention provides a simple solution to this problem, making it possible to optimize the operation of the gun for various types of images to be displayed on the screen of the tube, this being achieved by virtue of a structure of the beam-forming zone which allows the beam size to be adapted to various desired operating modes.

SUMMARY OF THE INVENTION

A method for operating a cathode-ray tube electron gun, wherein the gun comprises: a beam forming zone, for forming at least one electron beam, comprising in succession a cathode, and a plurality of electrodes with at least 2 control electrodes, and a main focusing zone consisting of at least one electrostatic lens. In the method, at least one variable potential is applied to at least one of the control electrodes of the beam-forming zone. This variable potential depends on the beam current so as to increase the size of the electron beam at the exit of the beam-forming zone for the low-current beams.

BRIEF DESCRIPTION OF THE DRAWINGS

The invention and its advantages will be more clearly understood with the aid of the description and of the drawings, among which.

DETAILED DESCRIPTION OF THE PREFERRED EMBODIMENT

Figure 1:
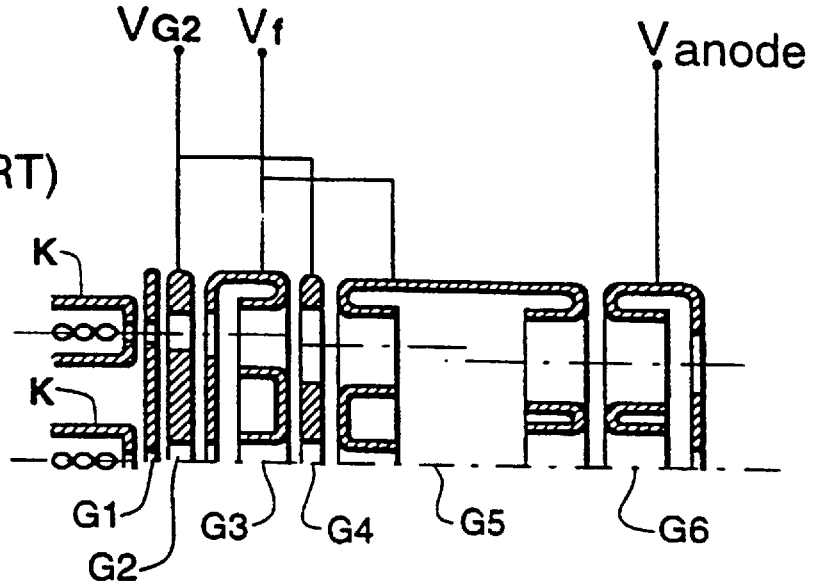
Fig. 1 (PRIOR ART)
FIG. 1 represents diagrammatically a longitudinal half-section of a gun according to the prior art.

A gun according to the prior art, as illustrated in FIG. 1, comprises a zone for forming an electron beam, generally consisting of an emissive cathode 1, a first electrode 2, called G1 and connected to earth, and a second, accelerating electrode 3, called G2 and connected to a voltage VG2 of about a few hundred volts. The gun, moreover, comprises electrode means (G3, G4, G5) constituting a prefocusing lens and electrode means (G5, G6) constituting a main focusing lens; the electrodes G3 and G5 being connected to a focusing voltage Vf and the final electrode G6 being connected to the anode high voltage.

Figure 2A:
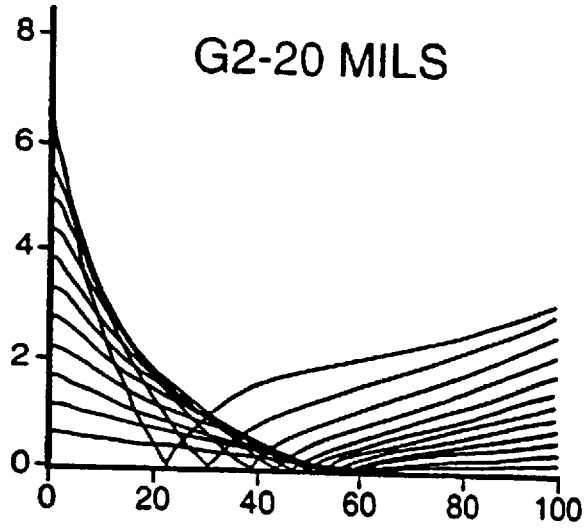
FIGS. 2A, 2B and 2C are graphs illustrating the effect of the thickness of the accelerating electrode G2 on the size of the beam exiting the zone for forming the said beam.
Figure 2B:
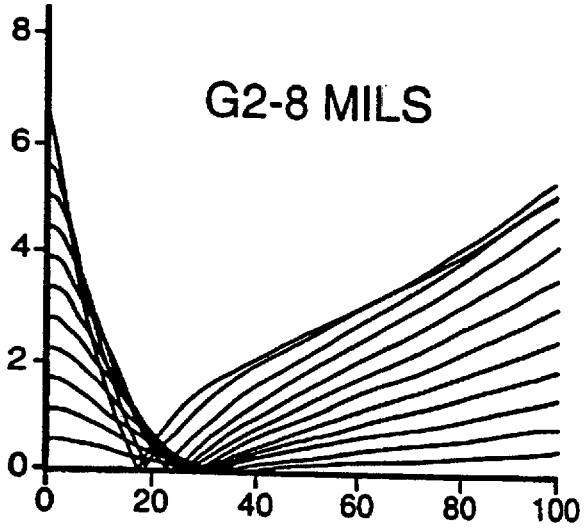
Figure 2C:
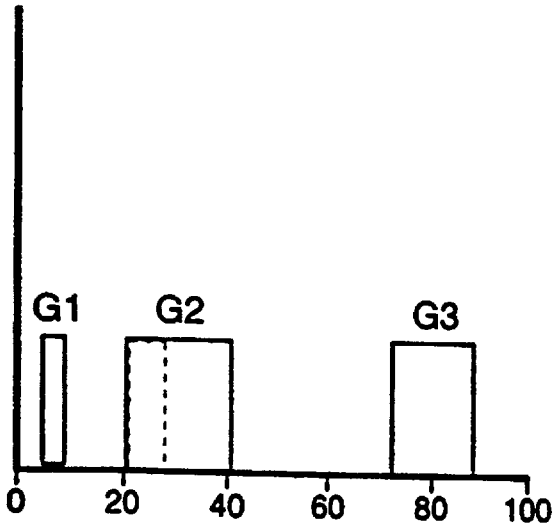

FIGS. 2A, 2B, 2C show the known effect of the thickness of the electrode G2 on the size of the beam exiting the zone for forming the beam. FIGS. 2A and 2B show the shape of the beam in longitudinal section, for G2 thicknesses of 20 mils and 8 mils, respectively. FIG. 2C shows the corresponding positions of the electrodes G1, G2, and the bottom part of G3. The left edge 0 in FIG. 1 corresponds to the plane of the cathode K. The electrode G2, in dotted lines, corresponds to an electrode G2 having a thickness of 8 mils, and the electrode G2, in solid lines, corresponds to an electrode having a thickness of 20 mils.

In a prior art gun, with an electrode G1 having a thickness of about 4 thousandths of an inch or 4 mils (0.1 mm) lying approximately 4 mils from the cathode, an electrode G2 lying 20 mils from the cathode and a lower part of G3 lying approximately 72 mils from the cathode, it is noted that the beam forms a node, also called a cross-over zone, which moves closer to the cathode as the thickness of G2 decreases, and that the beam exiting the forming zone, close to G3, increases in width as the thickness of G2 decreases.

Figure 3:
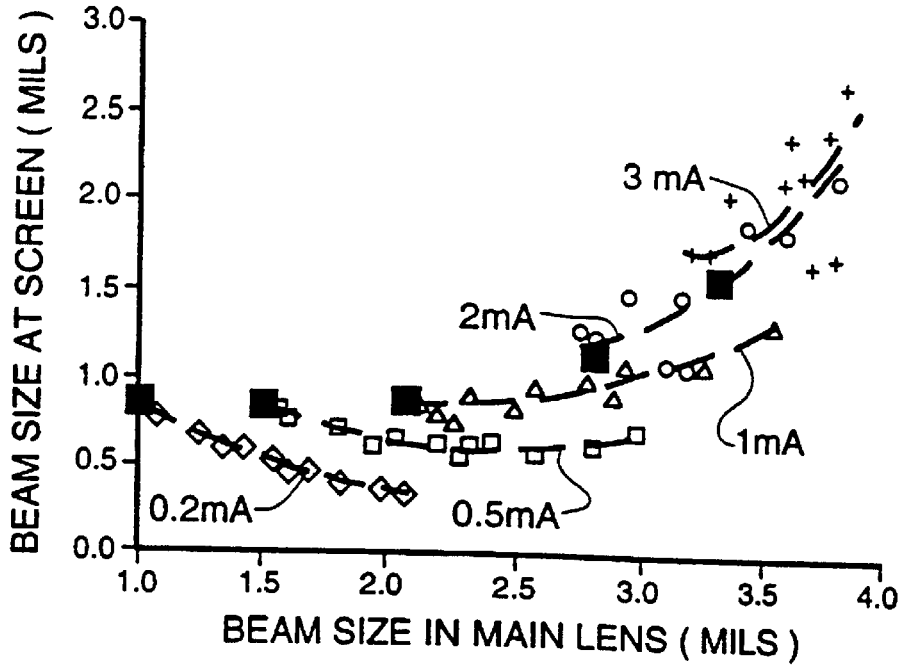
FIG. 3 is a graph showing, for a gun according to the prior art, the variation in the size of the impact area of the beam on the screen of the tube as a function of the size of the beam in the main lens, for defined beam currents.

Moreover, FIG. 3 shows that, for each beam current, the size (in Mils) of the point of impact of the beam on the screen depends on the size of the beam in the main lens, which, in turn, depends on the size of the beam exiting the forming zone described above, and therefore, ultimately, depends on the chosen thickness of the electrode G2.

The prior art gun structure usually is optimized for high currents, greater than 1 milliamp, because the minimum size of the point of impact of the beam on the screen corresponds to the minimum size of the beam in the main lens. However, for smaller currents, less than 1 mA, the minimum size of the point of impact of the beam on the screen no longer depends on a smallest size of the beam in the main lens, but rather result from a larger size of the beam in the main lens. For the gun considered above, with a G2 thickness of about 20 mils, the sizes of the beam in the main lens and those corresponding to the impact area of the beam on the screen are represented by solid rectangular points.

Figure 4:
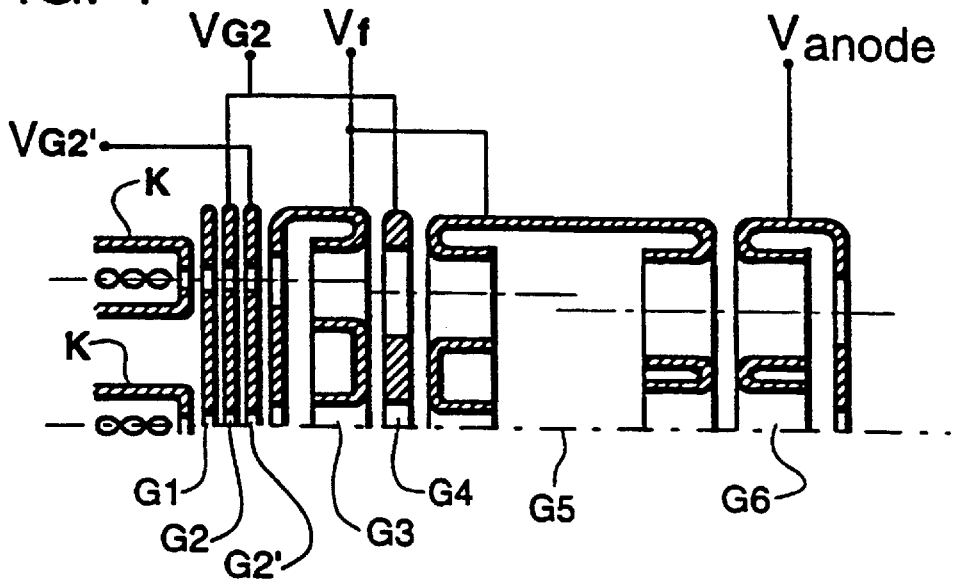
FIG. 4 represents diagrammatically a longitudinal half-section of a gun according to the invention.

A principle of the present invention consists in varying the G2 thickness virtually, so as to benefit from the advantages of an electrode G2 having a low thickness at high currents and from the advantages of a thin electrode G2 at low currents. To do this, at least one control electrode G2' is added to the electrode means of the beam-forming zone and voltages corresponding to the defined operating mode are applied to the control electrodes (G2, G2', etc.). For example, in an embodiment illustrated in FIG. 4, in which the gun is optimized for two types of operating mode corresponding to television mode and to XGA multimedia mode, two control electrodes G2 and G2' are placed in succession between the electrode G1 and the bottom part of the electrode G3.

Figure 5A:
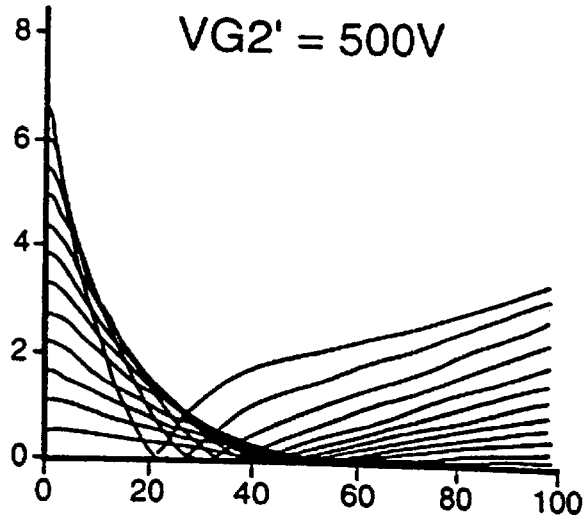
FIGS. 5A, 5B and 5C are graphs showing the effect of the voltage applied to the novel electrode structure of the beam-forming zone on the beam size.
Figure 5B:
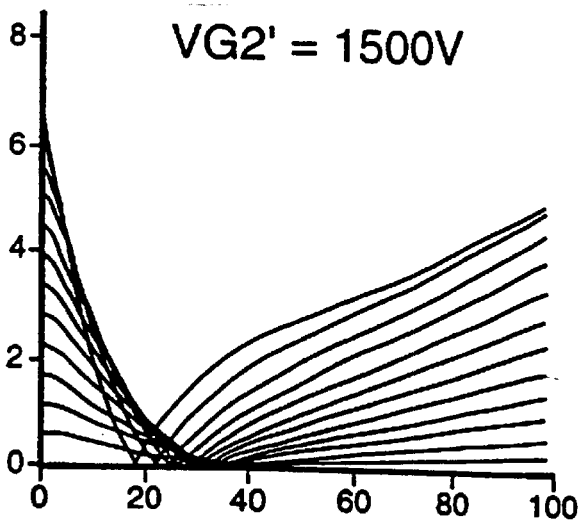
Figure 5C:
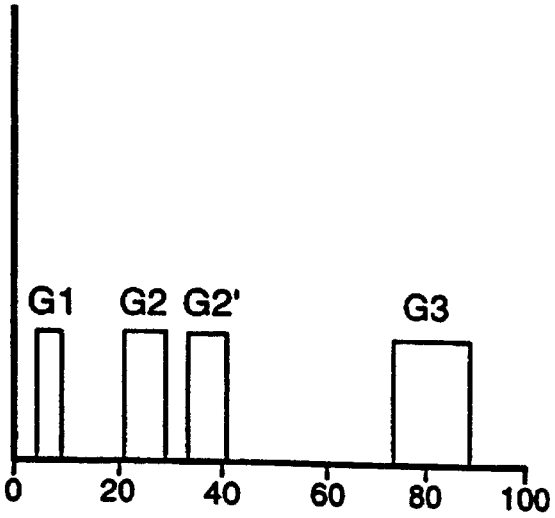

FIGS. 5A, 5B and 5C show that by applying a voltage to G2', which is equal to or greater than that applied to G2, the cross-over node of the electron beam moves closer to the cathode as the voltage VG2' increases, and likewise the size of the beam exiting the forming zone increases with VG2'.

In the television-type operating mode, the two electrodes G2 and G2' will be connected to the same constant potential, for example, between 200 volts and 300 volts. In order to display multimedia-type images, a potential difference will be applied between G2 and G2' so that the potential of G2' is above that of G2, for example, by raising the potential of G2' to a constant potential of about 100 V. In this way, the potential Pv applied to G2' changes from one constant value to another constant value, the switch from one value to another taking place, for example, automatically on the basis of a defined current threshold of about 1 mA. The switch may be made not by considering the value of the beam current but the chosen or detected operating mode, i.e., television mode or multimedia monitor mode.

Figure 6:
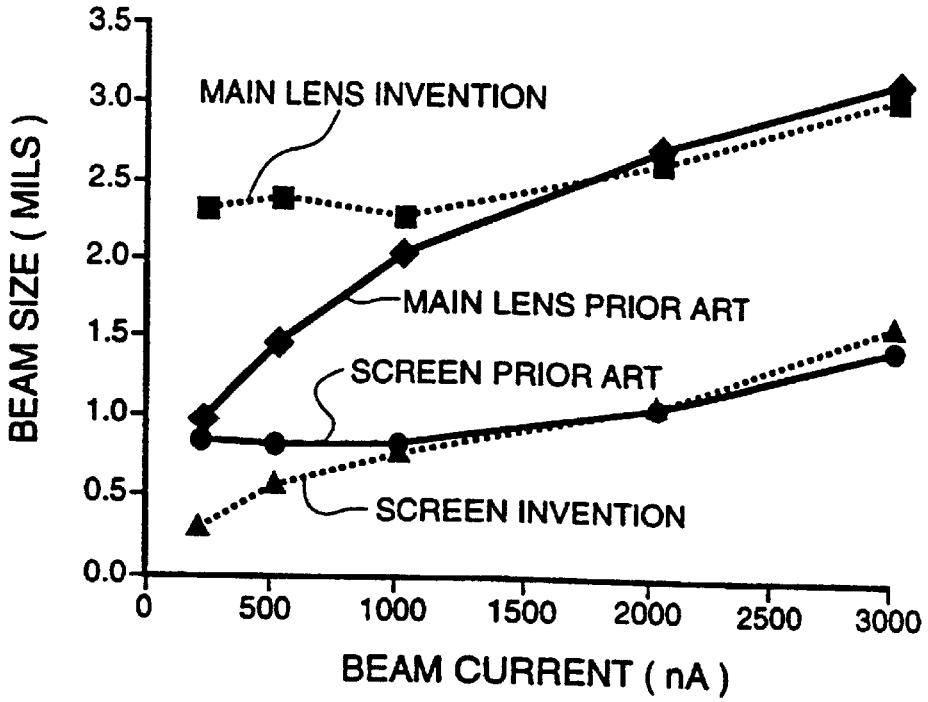
FIG. 6 is a graph illustrating the change in the beam size in the main lens and the size of the impact area of the beam on the screen as a function of the beam current, both for the gun according to the prior art and for the gun according to the invention.

FIG. 6 illustrates the improvement obtained by the device according to the invention. In the Figure, the device according to the prior art, having a conventional structure K, G1, G2 with an electrode G2 having a thickness of 20 mils, is compared with a structure, according to the invention, with two control electrodes G2 and G2' having a thickness of 8 mils and separated by a space of 4 mils. The predetermined beam-current threshold was fixed at 1 mA, VG2 and VG2' are equal to 260 V, and above 1 mA, VG2' is increased to 1000 V, VG2 remaining at its previous value. It may be seen that the size of the beam in the main lens is effectively enlarged in the region of low currents with respect to the prior art, which means, in this current range, that there is a significant improvement in the size of the impact area of the beam on the screen, allowing access to high resolution necessary for displaying multimedia images, for example, of the SVGA or XGA type.

More than two operating modes of the gun may be envisaged and, in this case, the voltage Pv will assume as many values as there are operating modes. For more precise control of the size of the beam exiting the zone for forming the said beam, it is possible to vary the voltage Pv not in a jump but gradually, depending on the detected value of the beam current. In this way, the size of the beam may be controlled over all the values of the beam-current range used.

Modifying the value of the voltage applied to one of the control electrodes may require modifying the voltage applied to another control electrode. This is because, in the usual triode structure of the beam-forming zone, K, G1, G2, the beam is modulated from the cathode by a negative modulation voltage, the G1 being raised to earth and the G2 to a preset threshold voltage, called the cut-off voltage, in order for there to be no beam current in the absence of modulation on the cathode. The switch from a mode in which the G2 and G2' are at the same cut-off voltage to a mode in which the voltage of the G2' becomes greater than the voltage of G2 requires modification of the voltage applied to the G2, so that the new voltage applied to the G2 corresponds to the threshold for emission of a beam current.

This modified structure may be developed for any type of gun by replacing the control electrode G2 by at least two electrodes G2 and G2', the longitudinal dimension of which is substantially the same as that of the initial electrode G2. In this way, the design of the gun in the region of the focusing stages will not have to be changed. Preferably, the space between the two electrodes is as small as possible so as to maintain a sufficient thickness at the two metal components which form the electrodes G2 and G2' in order to ensure good mechanical integrity of the said components. G2 and G2' will, for example, have a thickness equal to 8 Mils, and the space between the two electrodes will be 4 mils.

The principle of the invention may be discriminantly and advantageously applied to a single-beam gun or a multibeam gun for cathode-ray tubes.

What is claimed is:

1. A method for operating a cathode-ray tube electron gun, said gun comprising a beam-forming zone for forming at least one electron beam having a current comprising in succession an emissive cathode and a plurality of electrodes and a main focusing zone consisting of at least one electrostatic lens, comprising the steps of:

applying at least one variable potential to at least one of the electrodes of the beam-forming zone, wherein said potential depends on the beam current to increase the cross-sectional size of said electron beam at the exit of said beam-forming zone for low values of beam current.

2. A cathode-ray tube electron gun, said gun comprising:

a beam-forming zone for forming at least one electron beam having a current, comprising in succession an emmisive cathode and a plurality of successive electrodes, a main focusing zone consisting of at least one electrostatic lens, wherein said beam-forming zone comprises at least two control electrodes for applying two voltages respectively to said two control electrodes whereby the potential difference between said two voltages vary depending on the beam current.

3. The cathode-ray tube according to claim 2, wherein the potential difference variation between said two voltages undergo a voltage jump, depending on at least one predetermined threshold value of the beam current.

4. The cathode-ray tube according to claim 3, wherein the potential difference variation between said two voltages remains constant between two successive voltage jumps.

5. The cathode-ray tube according to claim 4, wherein the voltage applied to the control electrode closest to the cathode remains at a value less than or equal to the voltage applied to the control electrode furthest away from the cathode.

* * * * *